US010151482B2

(12) United States Patent
Teng et al.

(10) Patent No.: US 10,151,482 B2
(45) Date of Patent: Dec. 11, 2018

(54) SYSTEM FOR IGNITING AND CONTROLLING A GAS BURNING APPLIANCE

(71) Applicants: Yu-Shan Teng, Santa Fe Springs, CA (US); Peter Lee Cook, Santa Fe Springs, CA (US)

(72) Inventors: Yu-Shan Teng, Santa Fe Springs, CA (US); Peter Lee Cook, Santa Fe Springs, CA (US)

(73) Assignee: DEXEN INDUSTRIES, INC., Santa Fe Springs, CA (US)

( * ) Notice: Subject to any disclaimer, the term of this patent is extended or adjusted under 35 U.S.C. 154(b) by 438 days.

(21) Appl. No.: 14/748,836

(22) Filed: Jun. 24, 2015

(65) Prior Publication Data

US 2016/0377287 A1 Dec. 29, 2016

(51) Int. Cl.

| | |
|---|---|
| ***F23Q 9/08*** | (2006.01) |
| ***F23N 5/10*** | (2006.01) |
| ***F23N 5/26*** | (2006.01) |
| *F23Q 3/00* | (2006.01) |

(52) U.S. Cl.

CPC ..... *F23N 5/102* (2013.01); *F23N 5/265* (2013.01); *F23N 2027/36* (2013.01); *F23N 2029/02* (2013.01); *F23N 2029/14* (2013.01); *F23N 2041/08* (2013.01); *F23Q 3/00* (2013.01)

(58) Field of Classification Search

CPC ..... F23N 5/102; F23N 5/256
USPC ..... 431/46
See application file for complete search history.

(56) References Cited

U.S. PATENT DOCUMENTS

| | | | | |
|---|---|---|---|---|
| 2,494,833 | A | 1/1950 | Ray | |
| 2,987,566 | A | 6/1961 | Ray | |
| 4,032,363 | A | 6/1977 | Raag | |
| 4,131,413 | A * | 12/1978 | Ryno | F23N 5/105 431/44 |
| 4,778,378 | A * | 10/1988 | Dolnick | F23N 5/082 136/253 |
| 5,347,982 | A | 9/1994 | Binzer et al. | |
| 5,674,065 | A | 10/1997 | Grando et al. | |
| 6,257,871 | B1 | 7/2001 | Weiss et al. | |
| 6,261,087 | B1 | 7/2001 | Bird et al. | |
| 6,419,478 | B1 | 7/2002 | Kemp | |
| 6,667,594 | B2 * | 12/2003 | Chian | F23N 1/002 318/685 |
| 6,740,806 | B2 | 5/2004 | Starer et al. | |
| 7,018,200 | B2 | 3/2006 | Querejeta et al. | |

(Continued)

*Primary Examiner* — Jason Lau

(57) ABSTRACT

A system for controlling a gas burning appliance is disclosed. The system includes a central control unit. A pilot valve and main valve controls the flow of fuel from a fuel source to the pilot and main valve, respectively, and are configured for accepting an electrical current from a thermopile and from a power source. A spark generator generates for igniting fuel received by the pilot thereby generating a pilot flame. A flame sensor is adapted for monitoring the presence of a pilot flame. A thermopile proximate to the pilot burner is configured for generating an output electrical current for powering the pilot and main valve control devices. A relay routes electrical current between the power source and thermopile to the pilot and main valve control devices. A flame height regulating device conductively coupled with the power source is configured for adjusting a height of a main flame.

15 Claims, 5 Drawing Sheets

(56) References Cited

U.S. PATENT DOCUMENTS

| | | | | |
|---|---|---|---|---|
| 2005/0087221 | A1 | 4/2005 | Shah | |
| 2005/0161518 | A1* | 7/2005 | Munsterhuis | F23N 1/002 236/26 A |
| 2005/0247304 | A1 | 11/2005 | Weiss | |
| 2014/0165927 | A1 | 6/2014 | Zelepouga et al. | |
| 2014/0199641 | A1* | 7/2014 | Chian | F23Q 7/26 431/6 |

* cited by examiner

SYSTEM FOR IGNITING AND CONTROLLING A GAS BURNING APPLIANCE

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to the field of gas burning appliances, and more specifically to the field of gas burning appliances ignited by electronic control modules.

BACKGROUND

Throughout history, fireplaces and other devices have used thermal energy to heat spaces. In ancient times, wood was used in order to create heat. As technology evolved, gas and oil became the fuel source for fireplaces and other heat generating appliances. Gas and oil burning appliances have used various types of controllers or modules to initiate and control the combustion involved in generating heat in such heat generating appliances.

A thermopile is an electronic device that converts thermal energy into electrical energy. Thermopiles have been used within modules for gas burning fireplaces. For example, U.S. Pat. No. 6,261,087 discloses a thermopile that receives thermal energy from a pilot burner and converts such thermal energy to power the fuel valve and burner control. This design disclosed in U.S. Pat. No. 6,261,087 requires a user to manually light the pilot, which creates safety issues and is inefficient and inconvenient. Additionally, the invention disclosed in U.S. Pat. No. 6,261,087 requires that the pilot remain lit and powered by the fuel source at all times. As a result, this increases the amount of fuel consumption thereby increasing the cost to the consumer. Additionally, if the pilot becomes extinguished, then then pilot must be relit, which can create safety issues. The above-mentioned issues can be disadvantageous to the consumer.

Another example where a thermopile has been used in gas burning appliances is in U.S. Pat. No. 6,419,478. U.S. Pat. No. 6,419,478 discloses the use of a thermopile that receives thermal energy from a pilot flame. As current is generated by the pilot flame it is converted using a DC-to-DC converter to power a microprocessor and stepper motor. This design requires the use of a DC-to-DC converter. This design is disadvantageous as it requires the use of DC-to-DC converter, which may malfunction. Additionally, requiring a DC-to-DC converter may also increase the cost to a user.

Another example of the use of a thermopile with gas or oil burning appliances is United States Patent Application Publication Serial No. US 2014/0165927. This design discloses an unpowered rechargeable energy source that provides power to operate the combustion control system. This design causes a constant drain on the battery. As a result the battery life is decreased requiring frequent replacement and monitoring. As with the above prior mentioned prior art, United States Patent Application Publication Serial No. US 2014/0165927 can be disadvantageous to the consumer.

Therefore, a need exists to overcome the problems with prior art as discussed above, and particularly a need for a more cost effective and efficient ignition module for use with gas burning appliances.

SUMMARY

A system for igniting a gas burning appliance is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a system for igniting and controlling a gas burning appliance is disclosed. The system comprises a central control unit conductively coupled with a power source. The central control unit accepts electrical current from the power source. The central control unit is configured for: a. receiving a signal for a call for heat; b. transmitting a signal to a power source to provide electrical current to a spark generator; c. transmitting a signal to a power source to provide electrical current to a pilot valve control device; d. reading flame sensor data from a flame sensor adapted for monitoring a presence of a pilot flame for determining if a pilot flame is present; e. transmitting a signal to a power source to provide electrical current to a main valve control device; f. receiving a signal from a thermopile for determining if said thermopile is generating an output voltage over a predetermined value; and, g. transmitting a signal to a relay to route electrical current to a pilot valve control device and a main valve control device between electrical current generated from a power source and electrical current generated by a thermopile.

The system also includes a pilot valve configured for controlling a flow of fuel from a fuel source to the pilot. The pilot valve is controlled by a pilot valve control device conductively coupled to and configured for accepting an electrical current from a thermopile and from a power source. The system also includes a main valve configured for controlling a flow of fuel from the fuel source to a main burner. The main burner is controlled by a main valve control device conductively coupled to and configured for accepting an electrical current from a thermopile and from a power source.

A spark generator is conductively coupled to the central control unit and to the battery power source. The spark generator is adapted for sparking, wherein the spark generated is proximate to the pilot burner. The spark is adapted for igniting fuel received by the pilot thereby generating a pilot flame.

A flame sensor is conductively coupled to the central control unit, wherein the flame sensor is positioned proximate to a gap. The gap is proximate to the pilot and adapted to receive a pilot flame generated by the pilot. The flame sensor is adapted for monitoring the presence of a pilot flame, generating corresponding flame sensor data, and for sending a signal associated with the flame sensor data to the central control unit.

The system also includes a thermopile proximate to the pilot burner and conductively coupled to the central control unit, pilot valve control device and main valve control device. The thermopile is configured for generating an output electrical current converted from thermal energy received from the pilot flame. The thermopile output electrical current is adapted for being received by the pilot and main valve control devices.

At least one relay is conductively coupled with the central control unit, power source, and thermopile. The relay is configured for routing electrical current between the power source and thermopile to the pilot and main valve control devices.

A flame height regulating device is conductively coupled with the power source. The flame height regulating device accepts electrical current from the power source and is positioned proximate to the main valve and is configured for adjusting a height of a main flame.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
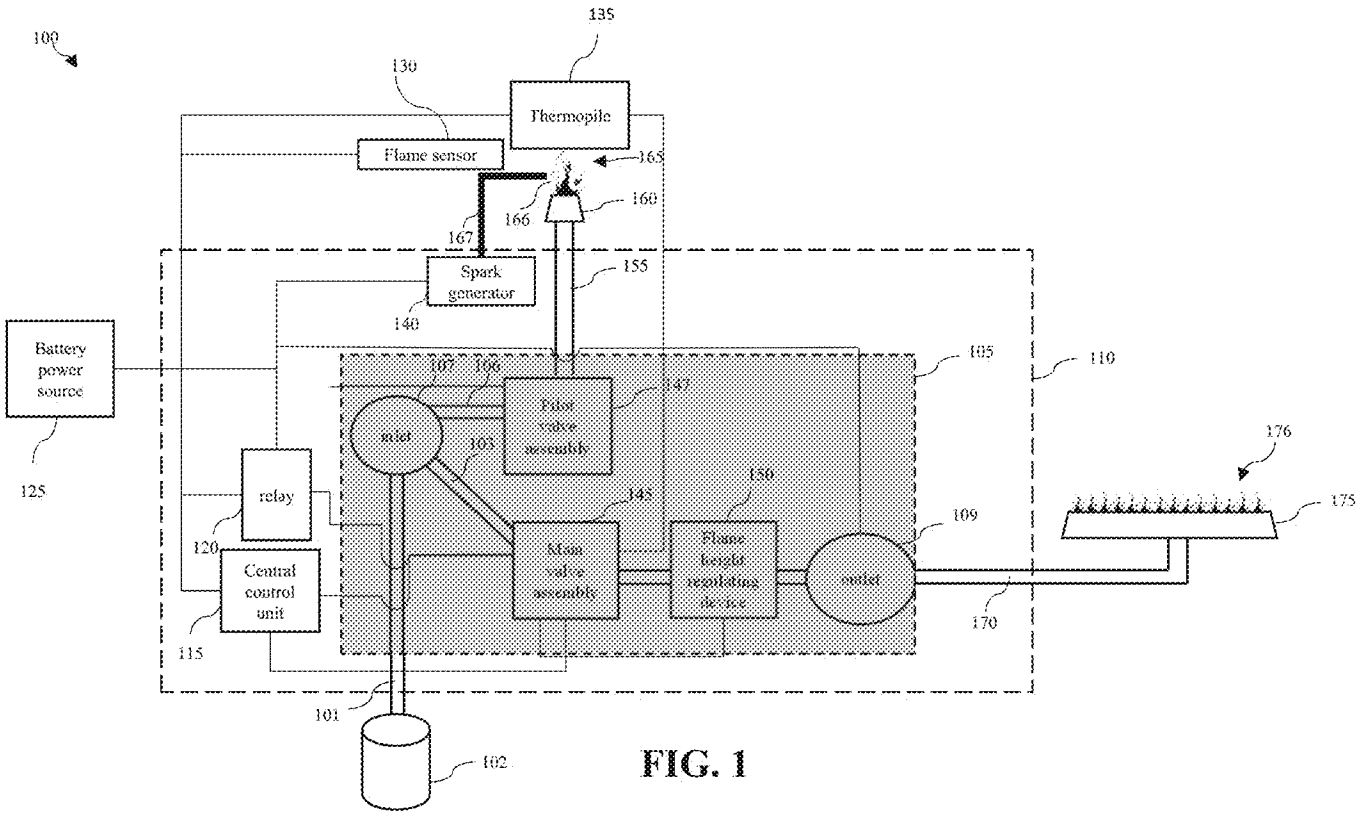
FIG. 1 is a block diagram illustrating the main components of a system for controlling a gas burning appliance, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a system for igniting and controlling a gas burning appliance. The system improves over the prior art by providing a battery power source, assisted by a thermopile, that energizes an electronic control unit. The system also improves over the prior art by increasing the battery life of the battery power source used in the system by using a thermopile and a relay to route power between power generated from the battery source and power generated by the thermopile in order to power the main valve control device and the pilot valve control device.

Referring now to the figures, FIG. 1 is a block diagram illustrating the main components of a system for igniting and controlling a gas burning appliance, according to an example embodiment. FIG. 1 shows that the system 100 includes a fuel supply 102 which may be a storage tank for storing compressed natural gas ("herein referred to as gas). In other embodiments the storage tank may be propane, butane or other conventional fuel gases. Fuel conduits and channels (further identified below) are used to transfer the fuel supply to and throughout the system). A fuel conduit 101 is used to transfer fuel from the fuel supply into a first housing 105. The outside of the first housing is represented as the dashed line 105 in FIG. 1. In the present embodiment, the first housing is an aluminum housing, which can be manufactured using procedures well known to those skilled in the art, such as casting, die casting, stir casting etc. In other embodiments the first housing may also be comprised of other ferrous materials or other materials typically used with gas burning appliances.

The first housing has an inlet 107 for the ingress of fuel into the system, via conduit or channel 101. The inlet can be a circular shaped opening or borehole adapted for receiving a fuel line and is well known to those skilled in the art. After entering into the system, fuel flows to a pilot valve assembly 147 via conduit or channel 106 and to a main valve assembly via conduit or channel 103.

The pilot valve assembly includes a pilot valve control device, such as a 1.46 volt solenoid, for controlling a pilot valve for allowing fuel to flow to a pilot or pilot burner 160, via a conduit 155. A 1.46 V solenoid opens valves when energized with a 1.46-volt current and which close a valve when no voltage is present. In the present embodiment, when the pilot solenoid receives approximately 1.46 V with a current at 0.9 mA, the pilot solenoid moves the pilot valve to the open position and can be maintained in such position when it receives approximately 0.27 V/0.2 mA. However, it is contemplated that a range of values may be used. When the pilot solenoid is energized the pilot solenoid moves the pilot valve in the closed position. Such solenoids are well known to those skilled in the art.

The pilot valve of the pilot valve assembly 147 is encased within the housing and is configured for controlling the flow of fuel from the fuel source 101 through the fuel conduits 106,155 to the pilot burner 160. The pilot valve is controlled by the pilot valve control device. Such valves are well known to those skilled in the art.

The main valve assembly includes a main valve control device, such as a 1.56 V solenoid, for controlling a main valve for allowing fuel to flow to a main burner 175, via conduit 170. A 1.56 V solenoid is a solenoid that opens a valve when energized with a 1.56 VDC and which can close a valve when no voltage is present. In the present embodiment, when the main receives approximately 1.56 VDC/0.5 mA, the main valve solenoid moves the main valve to the open position and can be maintained in such position when it receives approximately 0.34 VDC/0.1 mA. Such solenoids are well known to those skilled in the art.

The main valve of the main valve assembly 145 is configured for controlling a flow of fuel from the fuel source 101 to a main burner 175. The main burner is controlled by the main valve control device. Such valves are well known to those skilled in the art.

In the present embodiment, the system includes a flame regulating device 150 encased in the housing 110 for adjusting the height of the flame 176 emitted from the main burner. Such flame height control or regulating devices are well known to those skilled in the art. In the present embodiment, flame height regulating or control devices includes, a motor, coupled to the top of the aluminum or first housing. The motor can provide force to drive a shaft that allows a diaphragm to adjust air flow to the main burner. In another embodiment, the motor can be used to adjust the fuel flow to the main burner. The motor may comprise a brushless, direct current, electric motor such as a stepper motor, which divides a full rotation into a number of equal steps. In another alternative, the motor may be a linear actuator motor. The motor may be commanded to move and hold at one of the steps. However, such methods of regulating flame height and other embodiments can be used and are within the spirit and scope of the invention.

The first housing 105 also includes an outlet 109 for egress of fuel out of the first housing. The inlet and outlet comprise boreholes on the first housing. As with the inlet, the outlet can be a circular borehole on the first housing that is adapted to receive a fuel line or conduit.

The system also includes a central control unit 115 encased within a second housing 110. The perimeter of the second housing is represented by dashed line 110. In one embodiment the second housing can be an acrylonitrile butadiene styrene (ABS) housing, where the ABS housing being externally located from the first housing. In other embodiments, the second housing can comprise other materials having properties capable of withstanding and effectively shielding components held within the second housing from high temperatures.

The central control unit can be conductively and communicatively coupled, via a communication bus such as to allow communication and conductive coupling, to the main valve control device, pilot valve control device, battery power source, spark generator, flame sensor, thermopile, relay, and flame height regulating device. Such communication bus and conductive couplings are well known to those skilled in the art.

The central control unit comprises circuit boards as is conventional in the art that provides mounting for components used with the circuitry involved in the present invention. The central control unit comprises a processor or micro-processor having the necessary circuitry and components for performing its necessary functions. The central control unit may include volatile memory, such as RMA, or non-volatile memory, such as ROM, EPROM or flash memory. The central control unit comprises the control circuit that provides conduction paths to direct current between the various electrical components of the system, including the battery power source, thermopile, relay, main valve solenoid, pilot valve solenoid, flame height regulating device, flame sensor and spark generator. The central control unit is configured for: a. receiving a call for heat; b. transmitting a signal to the power source to provide electrical current to the spark generator; c. transmitting a signal to a power source to provide electrical current to a pilot valve control device; d. reading flame sensor data from a flame sensor adapted for monitoring a presence of a pilot flame for determining if a pilot flame is present; e. transmitting a signal to a power source to provide electrical current to a main valve control device; f. receiving a signal from a thermopile to determine if said thermopile is generating an output voltage over a predetermined value; and, g. transmitting a signal to a relay to route electrical current to a pilot valve control device and a main valve control device between electrical current generated from a power source and electrical current generated by a thermopile.

A thermopile 135 is positioned proximate to the pilot burner 160 and conductively coupled to the central control unit 115, the pilot valve solenoid and main valve solenoid. The thermopile is configured for generating an output electrical current converted from thermal energy received from the pilot flame. The thermopile output electrical current is adapted for being received by the pilot and main valve control devices. In one embodiment of the present embodiment, the thermopile is a 750 mV thermopile. That is, the thermopile supplies voltage when the input voltage exceeds 750 mV. Such thermopiles are well known to those skilled in the art.

The relay 120 is encased in the second housing and is conductively and communicatively coupled with the central control unit, power source, and thermopile. The relay is configured for routing or switching electrical current between the battery power source and thermopile to the pilot and main valve control devices. In other words, the relay routes the electrical current used for energizing the pilot valve control device and main valve control device between the battery power source and the output voltage generated by the thermopile. The switch is well known to those skilled in the art and may be a single-pole/double-throw, double-pole/single-throw switch, a double-pole double throw switch, a five-pole/double-throw, multi-contact switches, rotary switch or any combination thereof.

A spark generator 140 is conductively and communicatively coupled to the central control unit and to the battery power source. In one non-limiting embodiment, the spark generator can be a High Voltage (HV) spark generator and such HV spark generators are well known to those skilled in the art. The spark generator is adapted for generating a spark, which spark or arc can be positioned proximate to the pilot burner. The spark is adapted for igniting fuel received by the pilot thereby generating a pilot flame. In one embodiment, the spark generator is housed within the second housing and has a first end of a pair of conductors 167 conductively coupled to it. The second end of the pair of conductors has a space or gap between the conductors and is positioned proximate to the pilot. When the spark generator receives electrical current, an arc or spark is formed at the second end of the conductors. The second end of the pair of conductors 167 is positioned such that the when a spark is generated, the spark can ignite fuel exiting the pilot or pilot burner 160.

A flame sensor 130 is conductively coupled to the central control unit is used in conjunction with the central control unit to provide flame rectification. Flame Rectification is a method of flame sensing well known to those skilled in the art. In the present embodiment, the flame sensor is a sensor rod. The flame sensor is positioned proximate to a gap near the pilot burner. The gap 165 is situated so that it receives the pilot flame 166 generated by the pilot. The sensor is adapted for monitoring the presence of the pilot flame and generating corresponding flame sensor data. The flame sensor is configured for sending a signal associated with the flame sensor data to the central control unit.

The power source can be a battery power source situated externally from the second housing and conductively and communicatively coupled to the central control unit. In one non-limiting embodiment, the battery power source can be a 6 V battery. The batter power source may be a solar powered battery, rechargeable battery, non-rechargeable, lithium, a battery pack, lithium-ion, smart battery etc. or any combination thereof.

Figure 2:
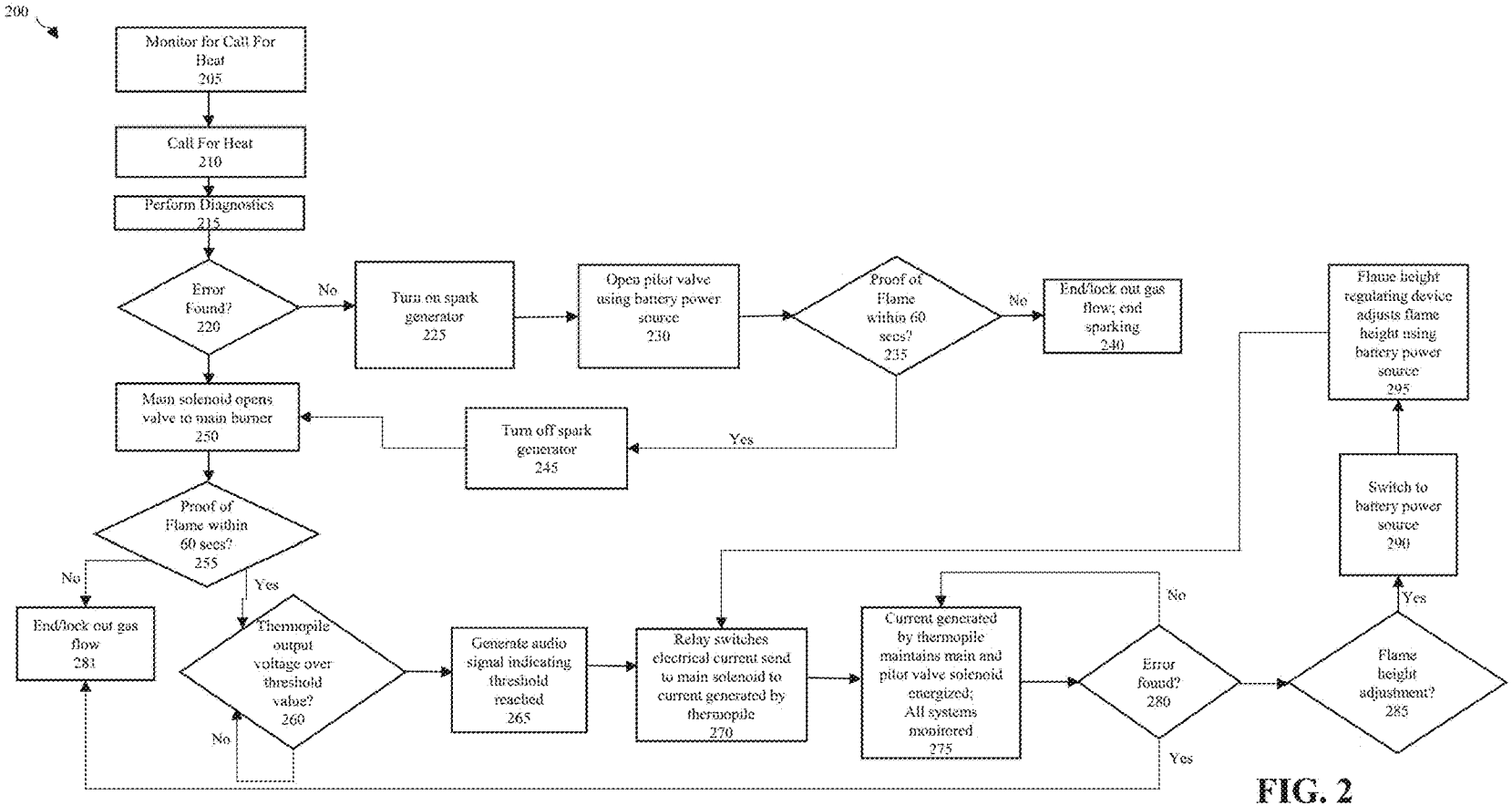
FIG. 2 is a flowchart describing the steps of the process performed by the system, according to an example embodiment.

Referring now to FIG. 2, FIG. 2 is a flowchart describing the steps of the process flow 200 performed by the system, according to an example embodiment. As shown in step 205, the system and central control unit is configured for monitoring the temperature of the outside environment through a sensor, such as a thermostat, thermocouple or other temperature sensing device, which such sensor is conductively and communicatively coupled to the central control unit 115. The temperature sensing device is configured for sending a signal to the central control unit when the thermostat or sensor senses temperatures that drop below a predetermined value. The predetermined or preprogrammed value may be adjusted by a user. In step 210, when temperature of the outside environment drops below a predetermined value, the thermostat sends a signal for a call for heat, which is received by the central control unit. In step 215, the central control unit can perform a plurality of preprogrammed diagnostic algorithms, from a plurality of data received from the flame sensor, HV spark generator, relay, pilot valve control device or solenoid, main valve control device or solenoid, battery, fuel supply, thermopile, and flame height regulating device, to determine proper operation, functioning, and connection of such components. Such components may also be communicatively and conductively coupled with such components via a communication bus. Such a communication bus is well known to those skilled in the art. Next, in step 220, if an error is found, the process flow moves to step 281 and the process ends and locks out gas flow. If no errors are found, the process moves to step 225. In step 225, the central control unit transmits a signal to the battery power source 125 to command the battery power source to provide electrical current to a spark generator. As mentioned above, in the present embodiment, the spark generator is a HV spark generator. The spark generator generates a spark proximate to the pilot.

Next, in step 230, the central control unit transmits a signal to the battery power source to provide electrical current to the pilot valve solenoid to open the pilot valve. The present invention is able to improve over the prior art by providing that the battery power source and central control unit allow for the pilot burner to be automatically lit. As mentioned above, in one embodiment, the pilot valve solenoid can be a 1.46 V solenoid that opens the pilot valve when activated by a 1.46 VDC is present and closes a valve when no voltage is present. After opening the pilot valve the pilot valve maintains in an open position if in one non-limiting embodiment, receiving 0.27 VDC/0.2 mA. After the pilot valve is opened, fuel flowing from the fuel source 102 to the pilot valve is lit by the spark generated by HV spark generator.

Next, in step 235, the central control unit reads flame sensor data from the sensor rod 130. As mentioned above, the sensor rod is adapted for monitoring the presence of a pilot flame for determining if a pilot flame 166 is present. The reading of such flame sensor data to determine if a flame is present is well known to those skilled in the art and such process can be commonly known as flame rectification. In step, 235 central control unit reads the flame sensor data received from the flame sensor or sensor rod to determine if proof of flame is received within a predetermined time (for example within 60 seconds). If no proof of flame is received within the predetermined and preprogrammed time, in step 240, the central control unit will de-energize the pilot valve solenoid to lock out the gas and send a signal to the spark generator to end spark generation. If proof of flame is received within the predetermined time, then the process flow moves to step 245. In step 245, the central control unit sends a signal to the HV spark generator to end spark generation.

Next, the process flow moves to step 250 and the central control unit transmits a signal to the battery power source to provide electrical current to the main valve solenoid to open the main valve to the main burner 175. As mentioned above, in one embodiment, the main valve control device or main valve solenoid is a 1.56 V solenoid that opens a valve when activated by a 1.56 VDC is present and closes a valve when no voltage is present. Next, in step 255, the system monitors the main valve burner to determine if the main burner has been lit or if proof of flame is received within a predetermined time (for example within 60 seconds). If no proof of flame is received within the predetermined time, then the process flow moves to step 281, and the central control unit transmits a signal to the battery power source to de-energize the pilot valve solenoid and main valve solenoid so as to lock out the gas flow and end the process.

If proof of flame is received within a predetermined time, then the process flow moves to step 260. In step 260, the central control unit receives and monitors a signal from the thermopile to determine if the thermopile is generating an output voltage over a predetermined value. As mentioned above, in one embodiment, the thermopile is a 750 mV thermopile positioned so that it receives thermal energy from the pilot flame 166 when present. However, other thermopiles size thermopiles may also be used.

Optionally, once the threshold voltage has been attained, the process flow moves to step 265, and generates an audio signal indicating that the predetermined threshold output voltage has been attained. The predetermined threshold voltage will vary depending on the thermopile, which may be adapted depending on application of use.

Next, the process flow moves to step 270, and the central control unit transmits a signal to a relay 122 to switch the flow of current from the battery power source to the current generated by the thermopile so as to energize the main valve solenoid and pilot valve solenoid. Next, in step 275, the central control unit monitors the data received from the components of the system. The current generated by the thermopile maintains the main and pilot solenoids in the energized state. The central control unit continuously monitors the system for errors.

In step 280, if errors are found, then the central control unit sends signals to de-energize the main valve solenoid and pilot valve solenoid to lock out the gas flow. Optionally, in step 285, if the system is running and receives a signal from the thermostat to regulate the height of the main burner flame, then the process flow moves to step 290.

In step 290, in order for the height of the flame to be adjusted, the flame height regulating device, which may include a motor, must temporarily draw current from the battery power source. Requiring the central control unit to temporarily switch current in order to temporality power the flame height adjusting device from the thermopile power to the battery power source, which eliminates the need for a DC to DC converter. To temporarily switch current, the central control unit transmits signals for the relay to temporarily switch current used to energize the system from the thermopile generated voltage to the battery power source voltage. After the flame has been adjusted to reach the desire height, the process flow moves to step 270, and the central control unit transmits a signal to the relay to switch the electrical current energizing the system from the battery power source back to the voltage generated by the thermopile.

Figure 3:
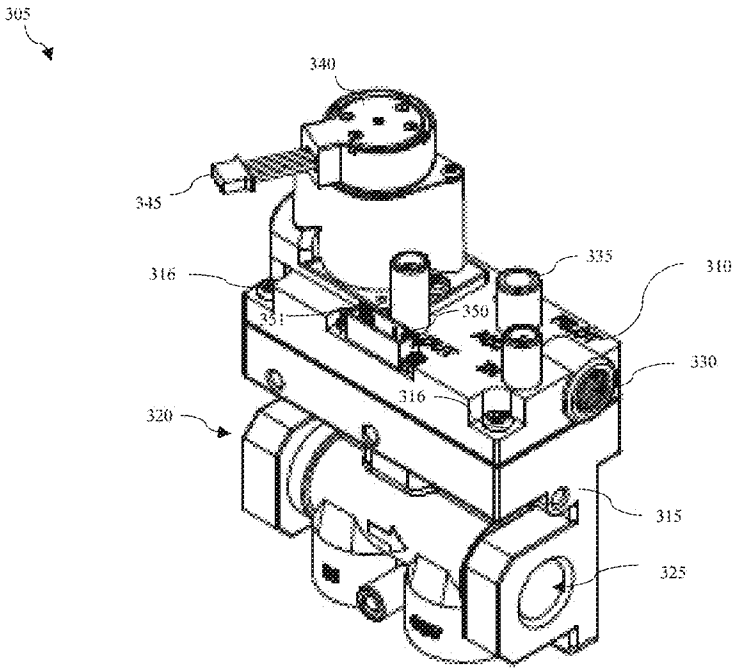
FIG. 3 is an illustration of a first housing of the system, according to an example embodiment.

FIG. 3 is an illustration of a first housing 305, according to an example embodiment. In one embodiment, the first housing comprises aluminum, however other materials having characteristics capable of withstanding pressures may be used. The first housing has the first part 310 that is coupled to a second part 315, which defines a cavity adapted for encasing the main valve, main valve solenoids, pilot valve, pilot valve solenoids and required circuitry. The first and second parts of the first housing may include a plurality of bosses adapted for receiving fasteners 316 which allow the first part to be connected or coupled to the second part. In the present embodiment, the fastener is a screw, however other fasteners may also be used and are within the spirit and scope of the invention.

The first housing includes an inlet 320 for the ingress of fuel into the first housing. A conduit, as illustrated in the block diagram as 101 in FIG. 1, may be connected from the fuel source to allow a flow of fuel into the first housing. The size of the inlet and be very depending on the application desired by the user, however in the present embodiment, a ⅜" National Pipe Thread ("NPT") pipe or ½" NPT pipe may be used. The first housing also includes an outlet 320 for the egress a fuel out of the first housing. As with the inlet, the outlet size may vary depending on the application desired by the user. However, in the present embodiment, a ⅜" NPT pipe or ½" NPT pipe may be used. Both the inlet and outlet comprise boreholes in the first housing. Inside the first housing further defines channels or conduits (illustrated in the block diagram in FIG. 1 as 101, 107, 106, 155) for allowing flow of fuel from the inlet to the pilot and to the outlet. The flow of fuel through a channel (illustrated in the block diagram of FIG. 1 as 106) to the pilot burner is controlled by the pilot valve (not shown), which is controlled by the pilot valve control device or pilot valve solenoid (which is a component of the pilot valve assembly illustrated in the block diagram of FIG. 1 as 147). As mentioned above, the pilot valve solenoid can be a 1.46 V solenoid that opens the pilot valve when activated or energized with 1.46 VDC/0.9 mA and is maintained with 0.27 VDC/0.2 mA and that closes the valve when no voltage is present.

A pilot flow adjusting device 335 can be included and encased within the first housing. The pilot flow adjusting device is used to increase or decrease the height of the pilot flame. In one non-limiting embodiment, the pilot flow adjusting device comprises a leadscrew received by a tubular shaped body on the body of the first housing having a threaded wall matching the threads of the lead screw. A user may adjust the flow of fuel to the pilot by adjusting the lead screw within tubular shaped body.

Inside the body of the first housing further defines a channel from the pilot valve to a pilot exit 330. In the present embodiment, the pilot exit is a circular opening on the exterior surface of the first housing. The pilot exit may also include threads adapted for receiving a pipe or conduit that leads to the pilot burner (illustrated as 160 in the block diagram of FIG. 1). Proximate to the pilot burner and conductively and communicatively coupled to the central control unit is a thermopile (not shown). In one embodiment, a 750 mV thermopile may be used. The thermopile is positioned proximate to the location or gap where the pilot flame is received. As mentioned above, the thermopile is positioned and adapted for receiving thermal energy from the pilot flame and for generating an output electrical current converted from such thermal energy of the pilot flame. Also positioned proximate to the pilot flame is the flame sensor (illustrated as 130 in the block diagram of FIG. 1). In one embodiment the flame sensor is a sensor rod.

The first housing may also be adapted for encasing a flame regulating device (illustrated as 150 in the block diagram of FIG. 1). The flame height regulating device is adapted for adjusting the height of the flame. The flame height regulating device may be a device, which is well known to those skilled in the art, which regulates and controls flame height by adjusting the flow of fuel received by the main burner (illustrated as 175 in the block diagram of FIG. 1) or by adjusting the airflow to the main burner. In the present embodiment, a motor 340 is coupled to the top of the first part of the first housing and facilitates the regulation or adjusting of the flame height. Terminal connection 345 is conductively coupled to the motor, which is conductively coupled to the central control unit and battery power source.

The flow of fuel through a channel (illustrated in the block diagram of FIG. 1 as 103) to the main burner is controlled by the main valve (not shown). The main valve is controlled by the main valve control device (which is a component of the main valve assembly illustrated in the block diagram of FIG. 1 as 145). As mentioned above, the main valve solenoid can be a 1.56 V solenoid that opens the pilot valve when activated or energized with a 1.56 VDC/0.5 mA is maintained in the open position when the solenoid receives 0.34 VDC/0.1 mA that closes the valve when no voltage is present.

A pair of electrical terminals 350, 351 on the first housing are conductively coupled to the main valve solenoid and pilot valve solenoid encased within the cavity formed by the first part and second part of the first housing. In the present embodiment, each electrical terminal comprises two pins, however other embodiments of electrical terminals may be used and are within the spirit and scope of the invention.

Figure 4:
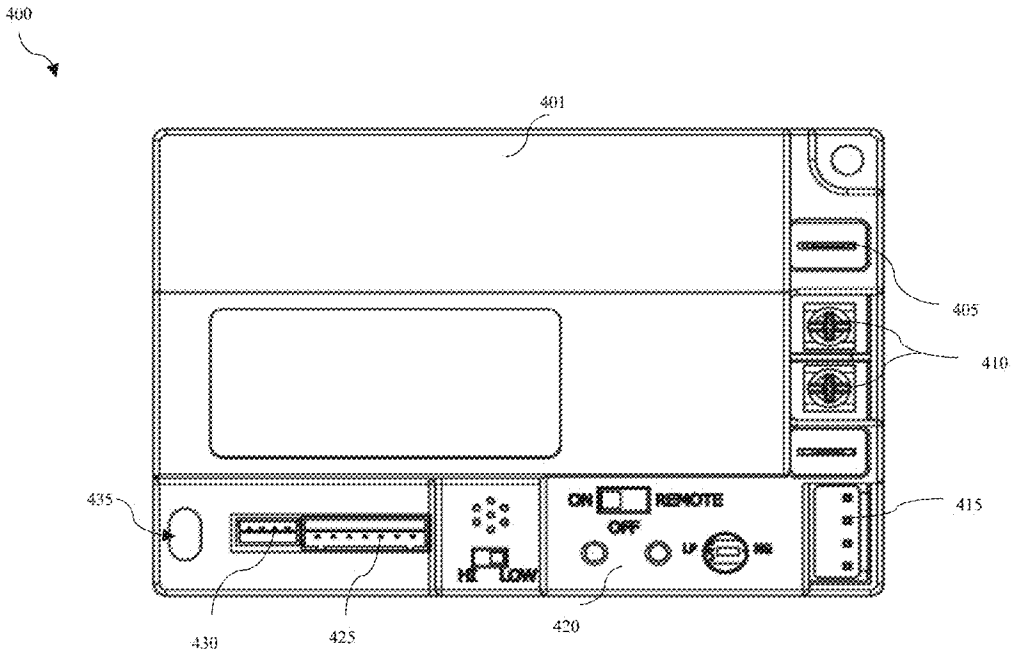
FIG. 4 is an illustration of the second housing of the system, according to an example embodiment; and, FIG. 5 is a block diagram of a system including an example computing device and other computing devices.

FIG. 4 is an illustration of the second housing 400, according to an example embodiment. The second housing may comprise ABS material, or other materials having the ability to withstand high temperatures. In the present non-limiting embodiment, the second housing is adapted to house the central control unit or processor. The central control unit can be conductively and communicatively coupled to the main valve solenoid, pilot valve solenoid, spark generator, flame sensor, thermopile, relay and flame height regulating or adjusting device and battery power source.

In the present embodiment, the housing is a substantially a rectangular shaped body 401 defining a cavity (not shown), in which the various electrical components and circuitry can be housed. As mentioned above, the central control unit can comprise circuit boards as is conventional in the art that provides mounting circuitry involved in the present invention. The central control unit comprises the control circuit that provides conduction paths to direct current between the various electrical components of the system, including the battery power source, thermopile, relay, main valve solenoid, pilot valve solenoid, flame height regulating device, flame sensor and spark generator.

The body of the second housing may also include holes 435 which can be used to couple the second housing, via fasteners, to portions of gas burning appliances. In the present embodiment, electrical terminals 410 on the second housing are conductively coupled to the central control unit (illustrated as 115 in FIG. 1). Electrical terminals 410 are conductively and communicatively coupled to the central control unit and is used for connecting, via a conductor, to the thermopile.

Electrical terminal 405 on the housing is conductively and communicatively coupled to the central control unit, battery power source, and high-voltage spark generator. Electrical terminal 505 can be used to conductively couple a 25 KV conductor proximate to the pilot burner in order to generate a spark proximate to the gap or space that receives the pilot flame in order to ignite the pilot burner.

Electrical terminal 415 on the second housing is conductively and communicatively coupled to the central control unit. An insulated conductor can be used to connect electrical terminals 415 to the flame sensor, which is positioned proximate to the gap where the pilot flame is received. In one embodiment, the flame sensor is a sensor rod and is used for determining if a flame is present. Such a process is well known to those skilled in the art. In the present embodiment, four elongated spades are used, however other embodiments of an electrical terminal or within the spirit and scope of the invention.

Electrical terminal 430 on the housing is conductively and communicatively coupled to the central control unit. Electrical terminal 430 can be used to conductively couple the central control unit, via an insulated conductor, to a motor of the flame height regulating device that is coupled to the first housing.

Electrical terminals 425 is the main wire harness and is adapted to be conductively coupled to the central control unit. The name wire harness can be used to conductively and communicatively couple the central control unit to the battery power source, relay, main valve solenoid, and pilot valve solenoid.

The second housing may also include a user interface 420 that allows a user to program the central control unit. Electrical terminal 430 conductively couples, via an insulated conductor, the motor coupled to the first housing to the central control units encased within the second housing. In the present embodiment, for pins are used as the electrical terminal, however other types of electrical terminals are within the spirits and scope of the invention.

Figure 5:
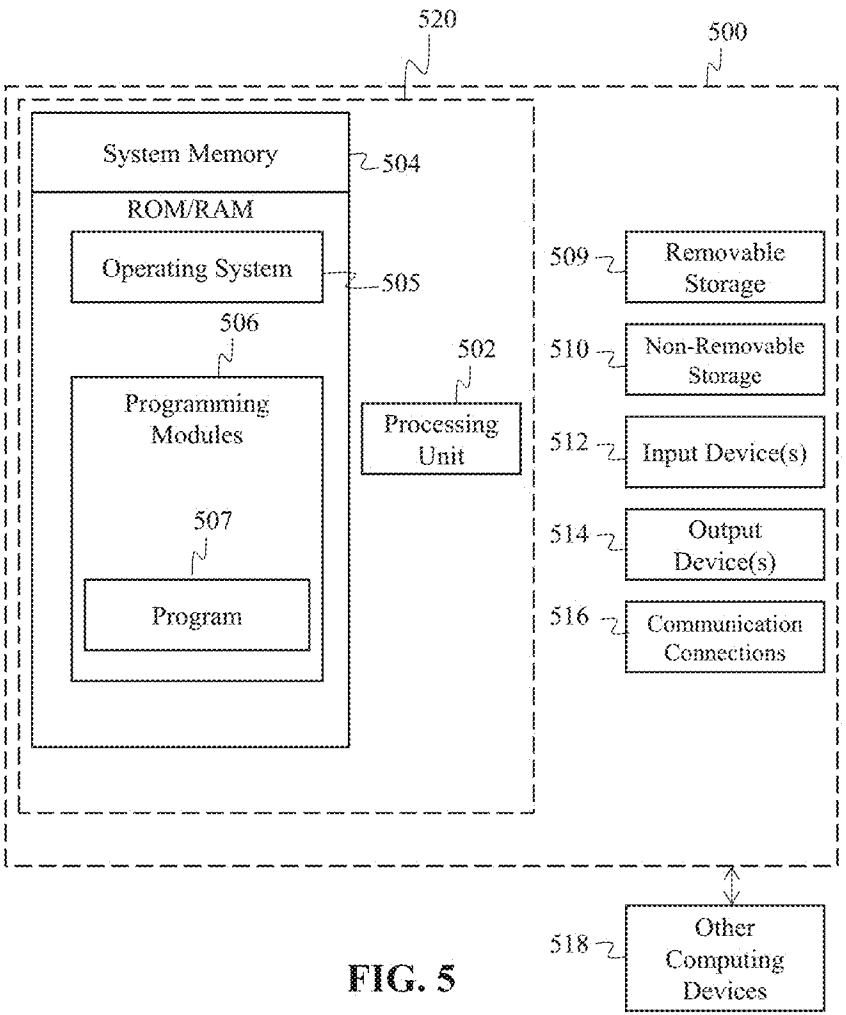

FIG. 5 is a block diagram of a system including an example computing device 500 and other computing devices. Consistent with the embodiments described herein, the aforementioned actions performed by central control unit 115 may be implemented in a computing device, such as the computing device 500 of FIG. 5. Any suitable combination of hardware, software, or firmware may be used to implement the computing device 500. The aforementioned system, device, and processors are examples and other systems, devices, and processors may comprise the aforementioned computing device. Furthermore, computing device 500 may comprise an operating environment for the method and process shown in FIG. 2 above.

With reference to FIG. 5, a system consistent with an embodiment of the invention may include a plurality of computing devices, such as computing device 500. In a basic configuration, computing device 500 may include at least one processing unit 502 and a system memory 504. Depending on the configuration and type of computing device, system memory 504 may comprise, but is not limited to, volatile (e.g. random access memory (RAM)), non-volatile (e.g. read-only memory (ROM)), flash memory, or any combination or memory. System memory 504 may include operating system 505, one or more programming modules 506 (such as program module 507). Operating system 505, for example, may be suitable for controlling computing device 503's operation. In one embodiment, programming modules 506 may include, for example, a program module 507. Furthermore, embodiments of the invention may be practiced in conjunction with a graphics library, other operating systems, or any other application program and is not limited to any particular application or system. This basic configuration is illustrated in FIG. 5 by those components within a dashed line 520.

Computing device 500 may have additional features or functionality. For example, computing device 500 may also include additional data storage devices (removable and/or non-removable) such as, for example, magnetic disks, optical disks, or tape. Such additional storage is illustrated in FIG. 5 by a removable storage 509 and a non-removable storage 510. Computer storage media may include volatile and nonvolatile, removable and non-removable media implemented in any method or technology for storage of information, such as computer readable instructions, data structures, program modules, or other data. System memory 504, removable storage 509, and non-removable storage 510 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 500. Any such computer storage media may be part of device 500. Computing device 500 may also have input device(s) 512 such as a keyboard, a mouse, a pen, a sound input device, a camera, a touch input device, etc. Output device(s) 514 such as a display, speakers, a printer, etc. may also be included. The aforementioned devices are only examples, and other devices may be added or substituted.

Computing device 500 may also contain a communication connection 516 that may allow device 500 to communicate with other computing devices 518, such as over a network in a distributed computing environment, for example, an intranet or the Internet. Communication connection 516 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 504, including operating system 505. While executing on processing unit 502, programming modules 506 may perform processes including, for example, one or more of the methods shown in FIG. 2 above. Computing device 502 may also include a graphics processing unit 503, which supplements the processing capabilities of processor 502 and which may execute programming modules 506, including all or a portion of those processes and methods shown in FIG. 2 above. The aforementioned processes are examples, and processing units 502, 503 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the invention.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A system for controlling a gas burning appliance comprising:

a central control unit conductively and communicatively coupled with a power source, wherein the central control unit accepts electrical current from the power source, and wherein the central control unit is configured for:

a. receiving a first signal for a call for heat;

b. transmitting a second signal to the power source to provide electrical current to a spark generator;

c. transmitting a third signal to the power source to provide electrical current to a pilot valve control device;

d. reading flame sensor data from a flame sensor adapted for monitoring a presence of a pilot flame for determining if the pilot flame is present;

e. transmitting a fourth signal to the power source to provide electrical current to a main valve control device;

f. receiving a fifth signal from a thermopile to determine if said thermopile is generating an output voltage over a predetermined value;

g. transmitting a sixth signal to a relay to route electrical current to the pilot valve control device and the main valve control device between electrical current generated from the power source and electrical current generated by the thermopile;

a pilot valve configured for controlling a first flow of fuel from a fuel source to a pilot burner, wherein the pilot valve is controlled by the pilot valve control device conductively coupled to and configured for accepting an electrical current from a thermopile and from the power source;

a main valve configured for controlling a second flow of fuel from the fuel source to a main burner, wherein the main burner is controlled by the main valve control device conductively coupled to and configured for accepting an electrical current from the thermopile and from the power source;

the spark generator conductively coupled to the central control unit and to the power source, wherein the spark generator is adapted for generating at least one spark, wherein the spark is generated proximate to the pilot burner, and wherein the spark is adapted for igniting fuel received by the pilot thereby generating the pilot flame;

the flame sensor conductively coupled to the central control unit, wherein the flame sensor is positioned proximate to a gap, wherein the gap is proximate to the pilot and adapted to receive the pilot flame generated by the pilot, wherein the flame sensor is adapted for monitoring the presence of the pilot flame and generating corresponding flame sensor data, and wherein the flame sensor is adapted for sending a seventh signal associated with the flame sensor data to the central control unit;

the thermopile proximate to the pilot burner and conductively coupled to the central control unit, pilot valve control device and main valve control device, wherein the thermopile is configured for generating thermopile output electrical current converted from thermal energy received from the pilot flame, and wherein the thermopile output electrical current is adapted for being received by the pilot control device and main valve control device;

a flame height regulating device for adjusting a height of a main flame and accepting power from only the power source; and wherein the relay is configured for temporarily switching electrical current powering the main valve control device, pilot valve control device, and the flame height regulating device from electrical current from the thermopile to electrical current from the power source when powering the flame height regulating device such that the flame height regulating device is only powered by the power source, and not the thermopile such that the need for a DC to DC converter is eliminated.

2. The system of claim 1, wherein the flame height regulating device comprises a motor coupled to the power source configured for controlling the flow of fuel to the main burner.

3. The system of claim 1, wherein the central control unit is further configured for performing diagnostic algorithms from a plurality of data received from, via a controller area network bus, the flame sensor, pilot valve control device, main valve control device, spark generator, power source and thermopile.

4. The system of claim 2, wherein the motor is a stepper motor or a linear actuator motor.

5. The system of claim 1, wherein the pilot valve control device is a 1.46 V solenoid that opens the pilot valve when activated with a 1.46 VDC and that closes the pilot valve when no voltage is present.

6. The system of claim 1, wherein the main valve control device is a 1.56 V solenoid that opens the main valve when activated with a 1.56 VDC and that closes the main valve when no voltage is present.

7. The system of claim 1, wherein the system receives the call for heat from at least one thermostat communicatively coupled to the system.

8. A system for controlling a flame height regulating device of a gas burning appliance comprising:

a central control unit conductively and communicatively coupled with a 6 V battery power source, wherein the central control unit accepts electrical current from the 6 V battery power source, and wherein the central control unit is configured for:

a. receiving a first signal for a call for heat from a thermostat;

b. transmitting a second signal to the 6 V battery power source to provide electrical current to a HV spark generator;

c. transmitting a third signal to the 6 V battery power source to provide electrical current to a pilot valve solenoid;

d. reading flame sensor data from a sensor rod adapted for monitoring a presence of a pilot flame for determining if the pilot flame is present;

e. transmitting a fourth signal to the 6 V battery power source to provide electrical current to a main valve solenoid;

f. receiving a fifth signal from a thermopile to determine if such thermopile is generating an output voltage over a predetermined value;

g. transmitting a sixth signal to a relay to route electrical current to the pilot valve solenoid or the main valve solenoid between electrical current generated from the 6 V battery power source and electrical current generated by the thermopile;

h. performing diagnostic algorithms from a plurality of data received via a controller area network bus communicatively coupled to the sensor rod, HV spark generator, pilot valve solenoid, main valve solenoid, thermopile, the flame height regulating device, 6 V battery power source and thermostat;

a pilot valve configured for controlling a first flow of fuel from the fuel source to a pilot burner, wherein the pilot valve is controlled by the pilot valve solenoid conductively coupled to and configured for accepting an electrical current generated from the thermopile and from the 6 V battery power source;

a main valve configured for controlling a second flow of fuel from the fuel source to a main burner, and wherein the main burner is controlled by the main valve solenoid conductively coupled to and configured for accepting an electrical current generated from the thermopile and from the 6 V battery power source;

the HV spark generator conductively coupled to the central control unit and to the 6 V battery power source, wherein the HV spark generator is configured for generating a plurality of sparks, wherein the sparks are generated proximate to the pilot burner such that the sparks generated ignite the fuel received by the pilot burner thereby generating the pilot flame;

the sensor rod conductively coupled to the central control unit, wherein the sensor rod is positioned proximate to a gap, wherein the gap is proximate to the pilot burner and adapted to receive the pilot flame generated by the pilot burner, wherein the sensor rod is adapted for monitoring the presence of the pilot flame and generating corresponding flame sensor data, and wherein the sensor rod is adapted for sending a seventh signal associated with the flame sensor data to the central control unit;

the thermopile proximate to the pilot burner and conductively coupled to the central control unit, pilot valve solenoid and main valve solenoid, wherein the thermopile is configured for generating a thermopile output electrical current converted from thermal energy received from the pilot flame, and wherein the thermopile output electrical current is configured for being received by the pilot valve solenoid and main valve;

the flame height regulating device for adjusting a height of a main flame and accepting power from only the 6 V battery power source; and, wherein the relay is configured for temporarily switching electrical current powering the main valve solenoid, pilot valve solenoid, and the flame height regulating device from electrical current from the thermopile to electrical current from only the 6 V battery power source when powering the flame height regulating device such that the flame height regulating device is only powered by the power source and not the thermopile, and such that the need for a DC to DC converter is eliminated.

9. The system of claim 8, wherein the flame height regulating device comprises a motor coupled to the 6 V battery power source configured for controlling the flow of fuel to the main burner.

10. The system of claim 9, wherein the motor is a stepper motor or a linear actuator motor.

11. The system of claim 10, wherein the pilot valve solenoid is a 1.46 V solenoid that opens the pilot valve when the pilot valve solenoid receives 1.46 VDC/0.9 mA, maintains the pilot valve open with 0.27 VDC/0.2 mA, and that closes pilot valve when no voltage is present.

12. The system of claim 11, wherein the main valve solenoid is a 1.56 V solenoid that opens the main valve when activated with 1.56 VDC/0.5 mA, maintains the main valve open with 0.34 VDC/0.1 mA, and that closes the main valve when no voltage is present.

13. A system for controlling a gas burning appliance comprising:

a pilot valve positioned proximate to a fuel source and a pilot burner, wherein the pilot valve is adapted for controlling a first flow of fuel from the fuel source to the pilot burner, and wherein the pilot valve is controlled by a pilot valve control device conductively coupled to and adapted for accepting an electrical current from both a thermopile and from a power source;

a main valve adapted for controlling a second flow of fuel from the fuel source to a main burner, and wherein the main burner is controlled by a main valve control device conductively coupled to and adapted for accepting an electrical current from both the thermopile and the power source;

a spark generator conductively coupled to the power source, wherein the spark generator is adapted for generating a spark proximate to the pilot burner, for igniting fuel received by the pilot burner thereby generating a pilot flame;

a flame sensor positioned proximate to a gap, wherein the gap is proximate to the pilot burner and adapted to receive the pilot flame generated by the pilot burner, wherein the flame sensor is adapted for monitoring the presence of the pilot flame;

the thermopile proximate to the pilot burner for generating a thermopile output electrical current converted from thermal energy received from the pilot flame, and wherein the thermopile output electrical current is adapted for being received by the pilot valve control device and main valve control device;

a flame height regulating device for adjusting a height of a main flame and accepting power from only the power source; and, wherein a relay is configured for temporarily switching electrical current powering the main valve control device and pilot valve control device from thermopile electrical current from the thermopile to electrical current from the power source when powering the flame height regulating device such that the flame height regulating device is only powered by the power source and not the thermopile, and such that the need for a DC to DC converter is eliminated.

14. The system of claim 13, wherein the pilot valve control device is a 1.46 V solenoid that opens the pilot valve when the pilot valve control device receives 1.46 VDC/0.9 mA, maintains the pilot valve open with 0.27 VDC/0.2 mA, and that closes the pilot valve when no voltage is present.

15. The system of claim 13, wherein the is a 1.56 V solenoid that opens the main valve when activated with 1.56 VDC/0.5 mA, maintains the main valve open with 0.34 VDC/0.1 mA, and that closes the main valve when no voltage is present.

* * * * *